US005879198A

United States Patent [19]

Sekimori et al.

[11] Patent Number: 5,879,198

[45] Date of Patent: Mar. 9, 1999

[54] BUTT TYPE TERMINAL UNIT WITH TOUCH PREVENTION STRUCTURE

[75] Inventors: Toshiyuki Sekimori; Yasuyoshi Fukao, both of Aichi; Shigemi Hashizawa, Shizuoka, all of Japan

[73] Assignee: Yazaki Corporation, Tokyo, Japan

[21] Appl. No.: 826,387

[22] Filed: Apr. 9, 1997

[30] Foreign Application Priority Data

Apr. 11, 1996 [JP] Japan ..... 8-089444

[51] Int. Cl.[6] ..... H01R 13/24

[52] U.S. Cl. ..... 439/700; 439/891; 439/289

[58] Field of Search ..... 439/289, 700, 439/824, 891

[56] References Cited

U.S. PATENT DOCUMENTS

| | | | |
|---|---|---|---|
| 3,851,946 | 12/1974 | Piaget et al. | 439/347 |
| 4,790,763 | 12/1988 | Weber et al. | 439/717 |
| 4,818,237 | 4/1989 | Weber | 439/693 |
| 5,588,852 | 12/1996 | Puerner | 439/135 |
| 5,681,187 | 10/1997 | Fukushima et al. | 439/921 |
| 5,703,324 | 12/1997 | Harder | 439/578 |

FOREIGN PATENT DOCUMENTS

| | | |
|---|---|---|
| 60-145560 | 9/1985 | Japan . |
| 3-48881 | 5/1991 | Japan . |

*Primary Examiner*—Neil Abrams

*Attorney, Agent, or Firm*—Armstrong, Westerman, Hattori, Mcleland & Naughton

[57] ABSTRACT

A butt-type connection terminal unit comprises first and second connection terminals whose front end surfaces are contacted to each other to make an electric connection therebetween and which include safety structure to prevent a person from accidentally touching the terminal front surfaces. The first and second connection terminals are provided, front end surfaces thereof, with respective plate-like insulators (5, 6) and slits (7, 8) at positions out of phase relative to each other, the plate-like insulators adapted for entrance into the corresponding slits when the front end surfaces are contacted to each other. A butt-type connection terminal unit is obtained in which the plate-like insulators serve to prevent a finger from touching the connection terminals, which realizes a stable electric connection and which is suited for downsizing connectors. A coaxial connector is also provided which employs the above connection terminal unit. A hollow cylinder (34) and a rod (36) are also usable as touch prevention structures.

7 Claims, 5 Drawing Sheets

BUTT TYPE TERMINAL UNIT WITH TOUCH PREVENTION STRUCTURE

BACKGROUND OF THE INVENTION

1. Field of the Invention

This invention relates to a connection terminal unit of a butt type having a finger-touching prevention structure, which is used, for example, in charging an electric automobile and to a coaxial connector employing the unit.

2. Description of the Related Art

Butt-type terminals—which are connected to each other in face-to-face relation—are advantageous as compared with pin/sleeve type terminals in that a smaller force is required and less abrasion is caused when connecting and disconnecting the terminals. There are, however, various problems to the butt-type terminals especially when used with a high-voltage, high-current passing connector such as a connector for an electric automobile.

FIG. 6 shows an example of a coaxial connector employing a conventional butt-type terminal unit (Japanese Utility Model Application Laid-Open Specification No. 3-48881), in which denoted 51 is a plug connector and 52 a receptacle connector.

The front end surface of a connection terminal 53 of the plug connector 51 is formed as a spherical surface 53*a,* and the front end surface of a connection terminal 54 of the receptacle connector 52 is formed as a conical recess 54*a.* In other words, to enlarge the contact surfaces of the terminals in a direction perpendicular to a fitting direction of the connectors 51, 52, the spherical surface 53*a* and conical recess 54*a* are employed, which in turn enlarges the opening 56 of a hood 55 of the plug connector 51, resulting in a fear that a finger or the like enters into touching with the connection terminal 53 to cause an electric shock. To avoid this, the hood 55 may be elongated so as to put the connection terminal 55 out of reach. It is, however, not practical since the entire length of the connector becomes elongated.

FIG. 7 shows a connector employing a conventional pin/sleeve-type terminal unit (Japanese Utility Model Application Laid-Open Specification No. 60-145560). More specifically, a connection terminal 57 of a not-shown plug connector has a small-diameter projection 58 axially projecting at the front end, and a screw portion 63 provided on the front end surface of the projection 58. A metallic ring 59 is force-fitted over the small-diameter projection 58, and a conical guide 60 of heat-resistant resin material is threaded over the screw portion 63. The receptacle connector 52' contains a connection terminal 62 which has a sleeve 61 for receipt therein of the pin-like connection terminal 57.

In the connector of FIG. 7, the front end of the sleeve 61 and the conical guide 60 cooperate with each other to guide the insertion of the pin terminal 57. In contrast, in the butt-type terminal unit of FIG. 6, neither of the connection terminals 53, 54 has a guiding operation.

The guide 60 of heat-resistant resin material serves to prevent a finger or the like from touching the connection terminal 57. The guide 60, however, is of a structure which is guided by the open end of the metallic sleeve 61 to be inserted into and pulled out of the sleeve, thereby possibly resulting in deformations of the resin material, the production and biting of shavings which may cause adverse effects on connections, and the falling-off of the guide 60 during the inserting or pulling out of the pin terminal 57.

SUMMARY OF THE INVENTION

This invention has been accomplished to overcome the above drawbacks and an object of this invention is provide a butt-type connection terminal unit which prevents a finger or the like from touching and causing an electric shock, in which a pair of opposed connection terminals have guiding means for stable electric connection, and which is suited for downsizing, and also a coaxial connector employing such a butt-type connection terminal unit.

In order to attain the object, according to an aspect of this invention, there is provided a butt-type connection terminal unit comprising: a first and second connection terminal whose end surfaces are contacted to each other to make an electric connection; an insulator provided projecting at the end surface of the first connection terminal for preventing a finger from touching the end surface; and a slit provided in the end surface of the second connection terminal for receipt therein of the insulator when the end surfaces of the first and second connection terminals are contacted to each other.

Preferably, a butt-type connection terminal unit comprises a first and second connection terminal whose end surfaces are contacted to each other to make an electric connection; an insulator provided projecting axially at the end surface of the respective first and second connection terminal for preventing a finger from touching the related end surface, the insulators being provided at positions out of phase relative to each other; and a slit provided in the end surface of the respective first and second connection terminal for receipt therein of the respective insulator when the end surfaces of the first and second connection terminals are contacted to each other.

Preferably, each of the insulators of the first and second connection terminals comprises a plate-like insulator divided into two by an intermediate, axially extended slit.

Preferably, one of the insulators of the first and second connection terminals comprises a plate-like insulator divided into two by an intermediate, axially extended slit, and the other of the insulators comprises a one-piece plate-like insulator.

Preferably, a butt-type connection terminal unit comprises: a first and second connection terminal whose end surfaces are contacted to each other to make an electric connection; a cylindrical insulator provided projecting axially at the end surface of the first connection terminal for preventing a finger from touching the end surface; a recess provided in the end surface of the second connection terminal; and an insulator pin projecting axially from inside the recess, the cylindrical insulator being received into the recess, and the insulator pin into the cylindrical insulator when the end surfaces of the first and second connection terminals are contacted to each other.

According to another aspect of this invention, there is provided a coaxial connector in which a pair of male and female connectors, one of which has a first connection terminal and the other has a second connection terminal, are fitted to bring end surfaces of the first and second connection terminals into contact with each other to make an electric connection, comprising: an insulator provided projecting axially at the end surface of the respective first and second connection terminal for preventing a finger from touching the related end surface, the insulators being provided at positions out of phase relative to each other; and a slit provided in the end surface of the respective first and second connection terminal for receipt therein of the respective insulator when the end surfaces of the first and second connection terminals are contacted to each other.

Preferably, a coaxial connector in which a pair of male and female connectors, one of which has a first connection terminal and the other has a second connection terminal, are fitted to bring end surfaces of the first and second connection terminals into contact with each other to make an electric connection, comprises a cylindrical insulator provided projecting axially at the end surface of the first connection terminal for preventing a finger from touching the end surface; a recess provided in the end surface of the second connection terminal; and an insulator pin projecting axially from inside the recess, the cylindrical insulator being received into the recess, and the insulator pin—into the cylindrical insulator when the end surfaces of the first and second connection terminals are contacted to each other.

With the construction as mentioned above, since the mating connection terminals are each provided with an insulator projecting at the front end surface thereof, connection operations can be safely done without the fear of a finger touching the connection terminals and causing an electric shock. Further, since the connection terminals are each provided with a respective insulator and slit, the terminals are guided into fitting with each other without causing otherwise possible slippage between contacted surfaces, and thus a stable electric connection is obtained.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described with reference to the attached drawings.

Figure 1:
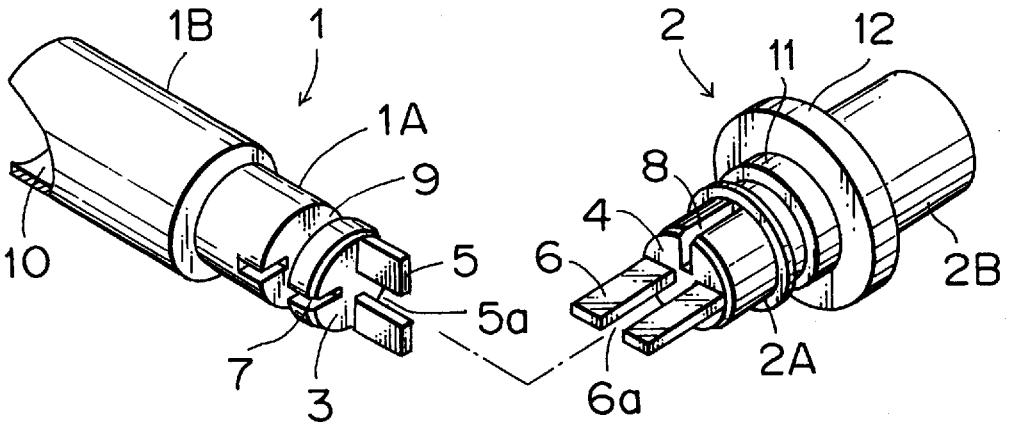
FIG. 1 is a perspective view of a connection terminal unit according to one embodiment of this invention.

As shown in FIG. 1, a connection terminal unit of a butt type is comprised of a pair of opposed connection terminals 1 and 2. One connection terminal 1 has at a front and rear half thereof a contact section 1A and a wire connection section 1B, respectively, which are formed continuously to each other, and the other connection terminal 2 likewise has at a front and rear half thereof a contact section 2A and a wire connection section 2B, respectively.

The contact sections 1A, 2A of the connection terminals 1, 2 are each columnar and provided at the front end surfaces 3, 4 with respective plate-like insulators 5, 6 projecting axially, and provided with slits 7, 8 for receipt therein of the corresponding insulators 6, 5.

The plate-like insulator 5, 6 are provided projecting at positions out of phase to avoid abutment or interference with each other and each divided into two by an intermediate relief 5*a*, 6*a*. The slits 7, 8 extend axially rearwardly from the front end surfaces 3, 4 of the respective contact sections 1A, 2A, with a depth reaching from an outer periphery of the contact sections 1A, 2A to a center thereof.

The contact section 1A at the front half of the one connection terminal 1 is on its outer periphery near the front end provided with an annular locking groove 9 for locking therein a later-described insulator sleeve 20, and the wire connection section 1B at the rear half comprises a cylindrical body of a diameter larger than that of the contact section 1A, to the hollow interior 10 of which is connected, as will be described later, a wire 21*a* of a cable 21 by solderless connection, welding or the like. The wire connection section 2B at the rear half of the other connection terminal 2 likewise comprises a cylindrical body of a diameter larger than that of the contact section 2A, and a stopper flange 12 is, via an enlarged diameter portion 11 larger in diameter than the contact section 2A, provided circumferentially between the contact section 2A and the wire connection section 2B.

Figure 2:
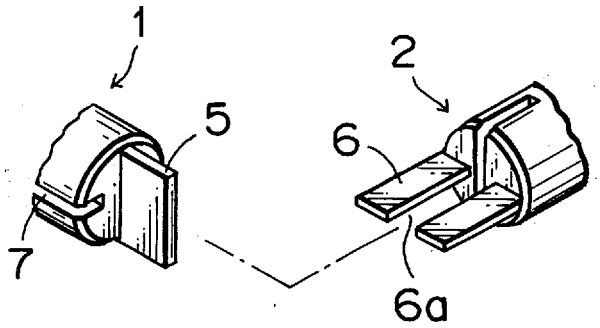
FIG. 2 is a perspective view of a connection terminal unit according to another embodiment of this invention.

FIG. 2 shows another embodiment of a butt-type connection terminal unit, in which the relief 5*a* as in the embodiment of FIG. 1 is not provided at an intermediate portion of the plate-like insulator 5 of the one connection terminal 1, and only the insulator 6 of the other connection terminal 2 is provided with the relief 6*a*. Thus, the insulator 5 is provided in one piece. The above may be made vice versa.

A coaxial connector will now be described which uses the connection terminals 1, 2 as mentioned above.

Figure 3:
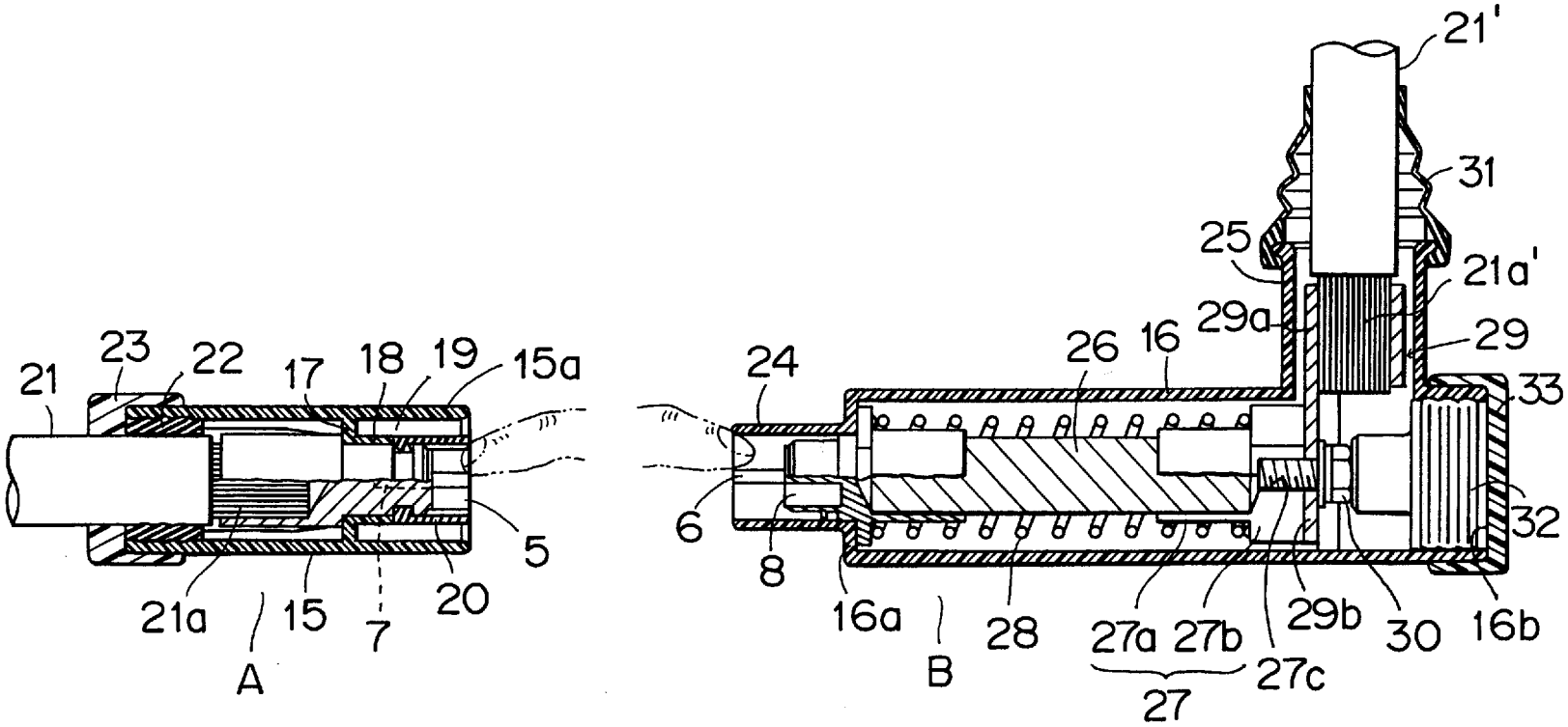
FIG. 3 is a longitudinal sectional view of a coaxial connector employing the connection terminal unit of FIG. 1, with its female and male connectors shown separated.

In FIG. 3, designated A is a female connector and B a male connector. The female connector A is comprised of a housing 15 of insulating synthetic resin which receives therein the one connection terminal 1, and the male connector B is likewise comprised of housing 16 of insulating synthetic resin which receives therein the other connection terminal 2.

The housing 15 of the female connector A comprises a cylindrical body which opens at both ends. In its interior towards the front end, the housing 15 is via a partition wall 17 provided with an inner cylindrical body 18 which cooperates with a front end portion 15*a* of the housing to define a fitting recess 19 therebetween for the male connector B. An insulator sleeve 20—which is of the same diameter as the inner cylindrical body 18—is fitted to a front end portion of the contact section 1A of the one connection terminal 1 and locked in the annular locking groove 9 as mentioned above. The wire 21*a* of the cable 21 is inserted into the hollow interior 10 of the rear half wire connection section 1B to be connected by soldering.

The connection terminal 1 is inserted through the open rear end into the housing 15, and the end surface of the wire connection section 1B abuts against the partition wall 17 to prevent the forward slipping-off of the connection terminal 1. A waterproof seal is made at the open rear end by fitting a waterproof rubber plug 22 therein, which plug is provided fitted over the cable 21, and a cap 23 is fitted over the rear end to prevent the rearward slipping-off of the connection terminal 1.

The housing 16 of the male connector B is cylindrical and has a fitting portion 24 projecting forwardly at a front wall 16*a* thereof, the fitting portion being smaller in diameter than the housing 16. On its outer periphery near the rear end, the housing 16 is provided with a perpendicular grip 25 which serves also as a cable connection portion. Braided steel carbon 26 is at one end connected to the wire connection section 2B of the other connection terminal 2 and at the other end connected to a wire connection section 27*a* of a relay terminal 27. Around the steel carbon 26 is wound a compression coil spring 28 which normally urges the connection terminal 2 forwardly.

The connection terminal 2 is inserted through an open rear end 16*b* of the housing 16, and its flange 12 abuts against a front wall 16*a* of the housing 16 to stop its advancement. A connection plate 29*b* of a power supply terminal 29 inserted into the grip 25 is fixed by a bolt 30 to a head 27*b* of the relay terminal 27 which is connected via the steel carbon 26 to the connection terminal 2. The power supply terminal 29 has a wire connection section 29*a* connected to a wire 21*a*' of a cable 21'. To the open end of the grip 25 through which the cable 21' extends is fitted a grommet 31 for waterproof seal, and a waterproof rubber plug 32 is fitted in the open rear end 16*b* of the housing 16, followed by the mounting of a cap 33 for waterproof seal.

With the construction as mentioned above, since the connection terminals 1, 2 of the female and male connectors A, B have the respective plate-like insulators 5, 6 projecting at their front end surfaces 3, 4, it is unlikely that a finger or the like directly touches the connection terminals 1, 2. Further, when received in the respective housings 15, 16, since the insulator sleeve 20 and the fitting portion 24 cooperate with the corresponding plate-like insulators 5, 6, a finger is prevented from entering the interior as shown in FIG. 3, thus excluding the possibility of electric shocks.

Figure 4:
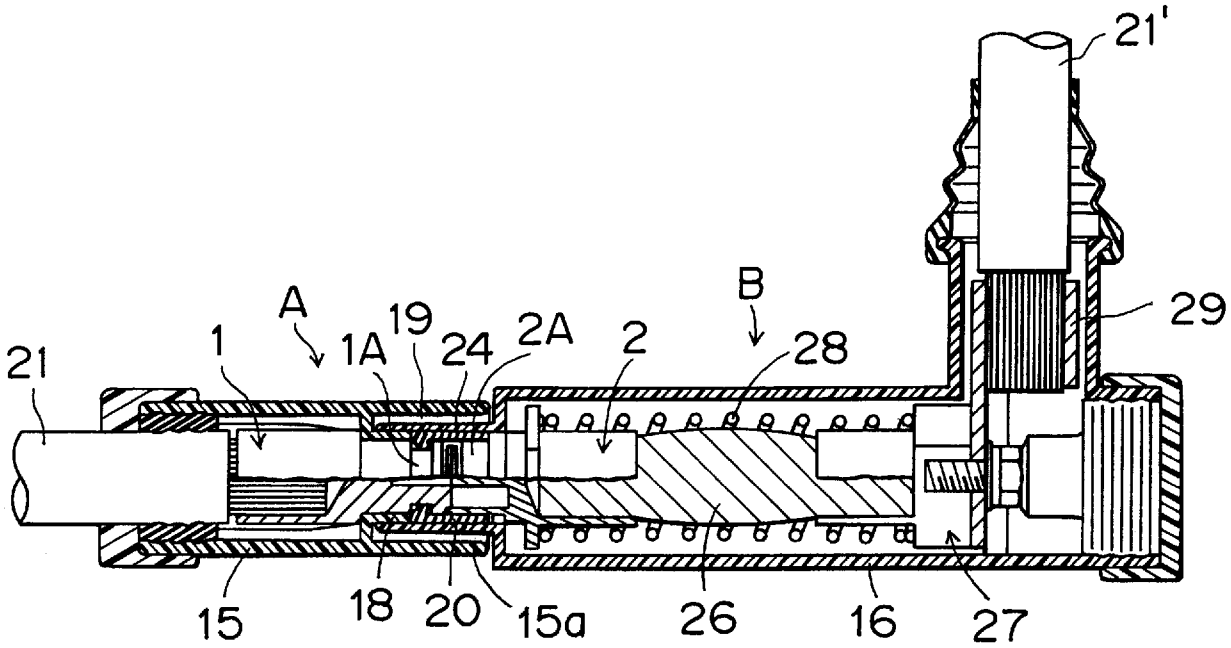
FIG. 4 is a longitudinal sectional view of the coaxial connector of FIG. 3, with its female and male connectors shown fitted.

The connection of the female and male connectors A and B is made simply by, as shown in FIG. 4, fitting the fitting portion 24 of the male connector B into the fitting recess 19 of the female connector A, which fitting recess 19 is formed between the inner cylindrical body 18 of the female connector A and insulator sleeve 20 and the front end portion 15*a* of the housing 15. In other words, the inner cylindrical body 18 and insulator sleeve 20 fits inside the fitting portion 24.

In this instance, the contact sections 1A, 2A of the connection terminals 1, 2 advance to each other, with their insulators 5, 6 inserted into and guided by the respective slits 8, 7, and when their front end surfaces 3, 4 contact face to face with each other, the connection terminal 2 moves backwards against the compression coil spring 28. Thus, owing to the repulsion of the coil spring 28, a strong contact pressure is obtained, leading to a stable electric connection.

The female and male connectors A, B are provided with locking means for holding the connectors in fully locked position to each other and locking means for holding the connection terminals 1, 2 connected to each other, which means, however, are known ones and omitted from the drawings.

Figure 5:
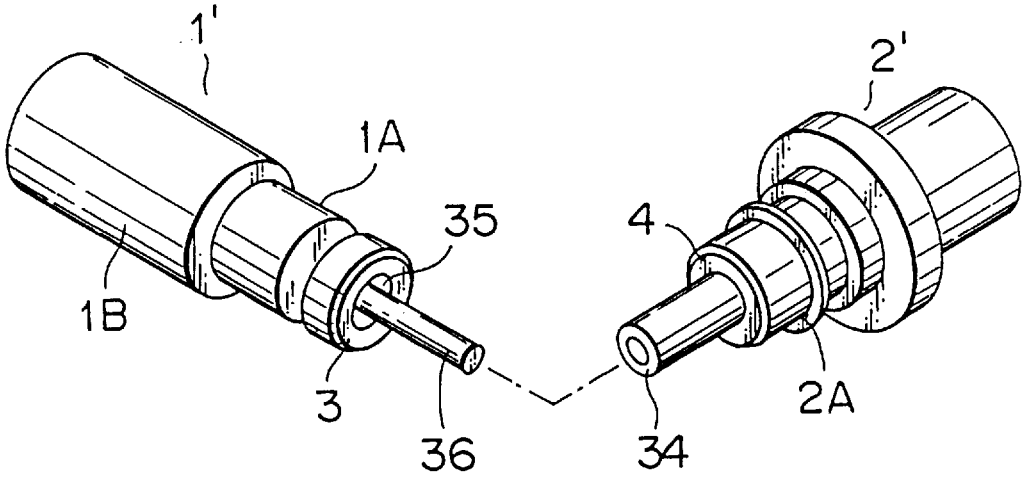
FIG. 5 is a perspective view of a connection terminal unit according to another embodiment of this invention.
Figure 6:
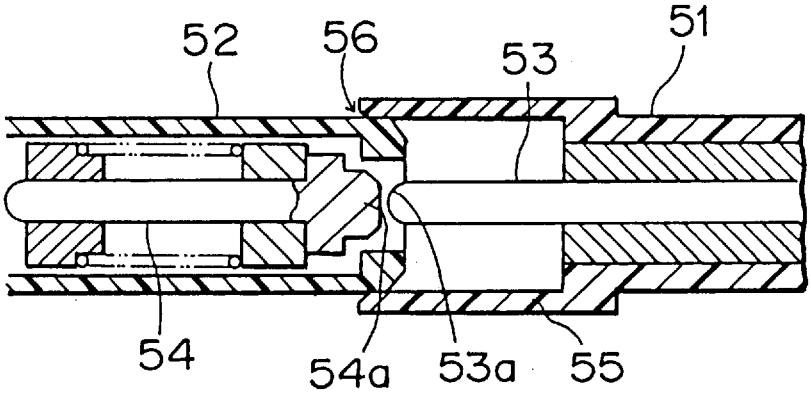
FIG. 6 PRIOR ART
FIG. 6 is an explanatory view of a conventional butt-type connection terminal unit.
Figure 7:
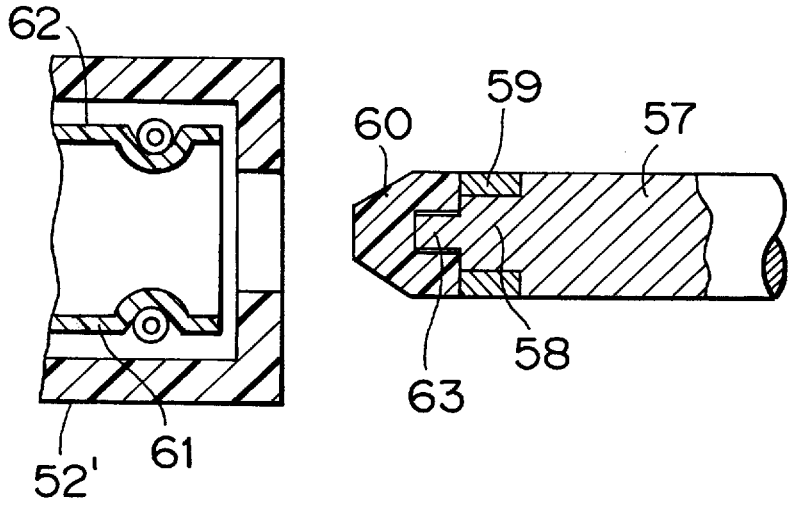
FIG. 7 PRIOR ART
FIG. 7 is an explanatory view of a conventional pin/sleeve-type connection terminal unit.

FIG. 5 is a perspective view of a butt-type connection terminal unit according to another embodiment of this invention.

The contact section 2A of one connection terminal 2' has a cylindrical insulator 34 projecting axially at a center of its front end surface 4, which substitutes for the plate-like insulator 6 and slit 8 as in the preceding embodiment, while the contact section 1A of the other connection terminal 1' has a circular recess 35 provided at a center of its front end surface 3 for receipt therein of the cylindrical insulator 34, and an insulator pin 36 projecting axially from inside the circular recess 35 for insertion into the cylindrical insulator 34 when the cylindrical insulator is received in the circular recess.

The rear half wire connection sections of the connection terminals 1', 2' are the same in structure as the above-described wire connection sections 1B, 2B, and received and locked in the same manner in the respective insulating housings 15, 16, and thus a general view of a connector having the connection terminals 1', 2' incorporated therein is omitted.

Also in the case where the connection terminals 1', 2' are employed, due to the insulator pin 36 and cylindrical insulator 34 projecting from their respective front end surfaces 3, 4, the touching of a finger with the connection terminals 1', 2' is prevented. Further, a mutual guiding operation is obtained by the cylindrical insulator 34 and the insulator pin 36 inserted therein.

The insulators 5, 6 and 34 and insulator pin 36 may be formed from insulating synthetic resin or ceramic, each separately from the metallic contact sections 1A, 2A of the connection terminals 1, 2 and 1', 2', and fixedly embedded in the respective contact sections. Alternatively, the metallic contact sections 1A, 2A may be formed integrally with cores of the insulators 5, 6 and 34 and insulator pin 36, followed by insulating the cores by insulating coating or the like.

Having now fully described the invention, it will be apparent to one of ordinary skill in the art that many changes and modifications can be made thereto without departing from the spirit and scope of the invention as set forth herein.

What is claimed is:

1. A butt-type connection terminal unit comprising:

a first and second connection terminal whose end surfaces are contacted to each other to make an electric connection;

an insulator provided projecting at the end surface of said first connection terminal for preventing a finger from touching the end surface; and a slit provided in the end surface of said second connection terminal for receipt therein of said insulator when the end surfaces of said first and second connection terminals are contacted to each other.

2. A butt-type connection terminal unit comprising:

a first and second connection terminal whose end surfaces are contacted to each other to make an electric connection:

an insulator provided projecting axially at the end surface of each of said respective first and second connection terminals for preventing a finger from touching the related end surface, said insulators being provided at positions out of phase relative to each other; and a slit provided in the end surface of each of said respective first and second connection terminals for receipt therein of said respective insulator when the end surfaces of said first and second connection terminals are contacted to each other.

3. The butt-type connection terminal unit according to claim 2, wherein each of said insulators of said first and second connection terminals comprises a plate-like insulator divided into two by an intermediate, axially extended slit.

4. The butt-type connection terminal unit according to claim 2, wherein one of said insulators of said first and second connection terminals comprises a plate-like insulator divided into two by an intermediate, axially extended-slit, and the other of said insulators comprises a one-piece plate-like insulator.

5. A butt-type connection terminal unit comprising:

a first and second connection terminal whose end surfaces are contacted to each other to make an electric connection;

a hollow cylindrical insulator provided projecting axially at the end surface of said first connection terminal for preventing a finger from touching the end surface;

a recess provided in the end surface of said second connection terminal; and an insulator pin projecting axially from inside said recess, said cylindrical insulator being received into said recess, and said insulator pin into said cylindrical insulator when the end surfaces of said first and second connection terminals are contacted to each other.

6. A coaxial connector in which a pair of male and female connectors, one of which has a first connection terminal and the other has a second connection terminal, are fitted to bring end surfaces of said first and second connection terminals into contact with each other to make an electrical connection, comprising:

an insulator provided projecting axially at the end surface of each of said first and second connection terminals for preventing a finger from touching the related end surface, said insulators being provided at positions out of phase relative to each other; and a slit provided in the end surface of each of said respective first and second connection terminals for receipt therein of said respective insulator when the end surfaces of said first and second connection terminals are contacted to each other.

7. A coaxial connector in which a pair of male and female connectors, one of which has a first connection terminal and the other has a second connection terminal, are fitted to bring end surfaces of said first and second connection terminals into contact with each other to make an electric connection, comprising:

a hollow cylindrical insulator provided projecting axially at the end surface of said first connection terminal for preventing a finger from touching the end surface;

a recess provided in the end surface of said second connection terminal; and an insulator pin projecting axially from inside said recess, said cylindrical insulator being received into said recess, and said insulator pin into said cylindrical insulator when the end surfaces of said first and second connection terminals are contacted to each other.

* * * * *

UNITED STATES PATENT AND TRADEMARK OFFICE

CERTIFICATE OF CORRECTION

PATENT NO.: 5,879,198
DATED : March 9, 1999
INVENTOR(S): Sekimori et al.

It is certified that error appears in the above-identified patent and that said Letters Patent is hereby corrected as shown below:

On the title page:

Item [73] Assignee, should be corrected as follows:

--Item [73] Assignees: Yazaki Corporation, Tokyo, Japan; and Toyota Jidosha Kabushiki Kaisha, Toyota-shi, Japan.--

Signed and Sealed this

Fourteenth Day of December, 1999

*Attest:*

*Attesting Officer*

Q. TODD DICKINSON

*Acting Commissioner of Patents and Trademarks*